US010480325B2

(12) United States Patent
Takabatake

(10) Patent No.: US 10,480,325 B2
(45) Date of Patent: Nov. 19, 2019

(54) BALANCED MIXED FLOW TURBINE WHEEL

(71) Applicant: BorgWarner Inc., Auburn Hills, MI (US)

(72) Inventor: Lauro Takabatake, Campinas (BR)

(73) Assignee: BorgWarner Inc., Auburn Hills, MI (US)

( * ) Notice: Subject to any disclaimer, the term of this patent is extended or adjusted under 35 U.S.C. 154(b) by 42 days.

(21) Appl. No.: 14/889,974

(22) PCT Filed: May 12, 2014

(86) PCT No.: PCT/US2014/037667
§ 371 (c)(1),
(2) Date: Nov. 9, 2015

(87) PCT Pub. No.: WO2014/189702
PCT Pub. Date: Nov. 27, 2014

(65) Prior Publication Data

US 2016/0168999 A1 Jun. 16, 2016

Related U.S. Application Data

(60) Provisional application No. 61/826,228, filed on May 22, 2013.

(51) Int. Cl.

| | |
|---|---|
| ***F01D 5/14*** | (2006.01) |
| ***F01D 5/02*** | (2006.01) |
| ***F01D 5/04*** | (2006.01) |
| ***F01D 5/16*** | (2006.01) |

(52) U.S. Cl.
CPC ..... *F01D 5/147* (2013.01); *F01D 5/027* (2013.01); *F01D 5/048* (2013.01); *F01D 5/16* (2013.01); *F05D 2220/40* (2013.01)

(58) Field of Classification Search
CPC ..... F01D 5/027; F04D 29/662
USPC ..... 416/144
See application file for complete search history.

(56) References Cited

U.S. PATENT DOCUMENTS 2,798,383 A * 7/1957 Cleave ..... F01D 5/027 74/571.1
5,605,444 A * 2/1997 Paton ..... F04D 29/2277 416/183
6,499,955 B2 * 12/2002 Choi ..... F04D 29/051 415/199.1

(Continued)

FOREIGN PATENT DOCUMENTS

| | | |
|---|---|---|
| EP | 2410126 | 1/2012 |
| KR | 101070904 | 10/2011 |

*Primary Examiner* — David E Sosnowski
*Assistant Examiner* — Cameron A Corday
(74) *Attorney, Agent, or Firm* — BrooksGroup

(57) ABSTRACT

A mixed flow turbine wheel (1) for a turbocharger includes a hub (6) extending axially between a nose (10) and a partial back wall (9) defining an axis of rotation in the axial direction. The partial back wall (9) extends circumferentially from the hub (6) to an outer peripheral edge (11). A plurality of turbine blades (7) are coupled to the hub (6) and extended beyond the peripheral edge (11). The blades (7) are spaced circumferentially about the hub (6) at equal intervals around the axis of rotation. At least one scallop cut (5) is formed in the peripheral edge (11) at the partial back wall (9) for balancing the turbine wheel (1) about the axis rotation.

9 Claims, 2 Drawing Sheets

(56) References Cited

U.S. PATENT DOCUMENTS

| | | | | |
|---|---|---|---|---|
| 7,481,625 | B2 | 1/2009 | Kim | |
| 8,397,506 | B1 * | 3/2013 | Wright | F01K 7/32 415/110 |
| 2004/0115044 | A1 * | 6/2004 | Osako | F01D 5/048 415/143 |
| 2010/0098546 | A1 * | 4/2010 | Emmerson | B23P 15/006 416/213 R |
| 2011/0141693 | A1 * | 6/2011 | Walsh | F04D 29/4226 361/702 |
| 2013/0017091 | A1 | 1/2013 | Duong et al. | |
| 2016/0177726 | A1 * | 6/2016 | Striedelmeyer | F01D 5/12 416/144 |

* cited by examiner

BALANCED MIXED FLOW TURBINE WHEEL

CROSS-REFERENCE TO RELATED APPLICATION

This application claims priority to and all benefits of U.S. Provisional Application No. 61/826,228, filed on May 22, 2013, and entitled "A Balanced Mixed Flow Turbine Wheel."

BACKGROUND OF THE INVENTION

1. Field of the Invention

The present invention relates to a method for balancing a shaft-and-wheel assembly of a turbocharger. More particularly, the present invention relates to a method of removing balance stock from a mixed flow turbine wheel having a partial back-wall.

2. Description of Related Art

A turbocharger is a type of forced induction system used with internal combustion engines. Turbochargers deliver compressed air to an engine intake, allowing more fuel to be combusted, thus boosting an engine's horsepower without significantly increasing engine weight. Thus, turbochargers permit the use of smaller engines that develop the same amount of horsepower as larger, normally aspirated engines. Using a smaller engine in a vehicle has the desired effect of decreasing the mass of the vehicle, increasing performance, and enhancing fuel economy. Moreover, the use of turbochargers permits more complete combustion of the fuel delivered to the engine, which contributes to the highly desirable goal of a cleaner environment.

Turbochargers typically include a turbine housing connected to the engine's exhaust manifold, a compressor housing connected to the engine's intake manifold, and a center bearing housing coupling the turbine and compressor housings together. A turbine wheel in the turbine housing is rotatably driven by an inflow of exhaust gas supplied from the exhaust manifold. A shaft rotatably supported in the center bearing housing connects the turbine wheel to a compressor impeller in the compressor housing so that rotation of the turbine wheel causes rotation of the compressor impeller. The shaft connecting the turbine wheel and the compressor impeller defines an axis of rotation. As the compressor impeller rotates, it increases the air mass flow rate, airflow density and air pressure delivered to the engine's cylinders via the engine's intake manifold.

There are three basic types of turbine wheels. The radial turbine wheel has the fluid flowing around the edge of the turbine wheel. An example of such a wheel is a water wheel. An axial turbine has the fluid flowing through the turbine blades. A windmill is an example of an axial turbine. The mixed flow turbine wheel combines the designs of both the axial flow and radial flow turbines. The present invention relates to mixed flow turbine wheels.

The turbine wheel operates in a high temperature environment and the turbine wheel may reach temperatures as high as 1922° F. (1050° C.). This elevated temperature can have an effect on material properties turbine wheel and make it less able to withstand stress. In addition, the turbine wheel of a turbocharger rotates very fast. The rotation speed of a turbine wheel is size dependent and smaller turbine wheels can rotate faster than larger wheels. A small turbocharger turbine wheel used in conjunction with an internal combustion engine may reach rotational velocities as high as 350,000 RPM. The rapid rotation of the turbine wheel creates large centrifugal forces or centrifugal stress on the wheel. The combination of the high temperature operating environment and the high rotation speed make balancing the turbine wheel extremely important. In addition the turbine wheel is heavy and made from expensive materials. Any balance problems can lead to early failure and the loss of the expensive turbine wheel and shaft.

The turbine wheel is one of the most expensive components of the turbocharger because it is typically cast from a nickel based superalloy with over seventy percent (70%) by weight in nickel. This equates to approximately five percent (5%) of the weight of the entire turbocharger. Thus, it is desirable for the turbine wheel to have a long lifecycle. Lack of balance in the turbine wheel can cause vibrations which may be transmitted the rest of the turbine and thus the rotational balance of the turbine wheel is critical for both performance and lifecycle of both the turbine wheel and the entire turbocharger.

However, the rotational balance of the turbine wheel is unknown until it is part of a finished shaft-and-wheel assembly, and unfortunately, the balancing step is generally the last operation in the manufacture of the shaft-and-wheel assembly. For one example, a turbine wheel casting may be held in a chuck to drill a center hole in a nose on a front side of the turbine wheel casting. The shaft is then welded to a weld boss on a back side of the turbine wheel casting. After heat treating the weld, the shaft-and-wheel assembly is machined, including finish machining a plurality of turbine blades on the turbine wheel itself. A distal end of the shaft is threaded and then the shaft-and-wheel assembly is balanced. If the shaft-and-wheel assembly must be scrapped, at this point, due to balance problems, there is a large non-recoverable cost.

The turbine wheel may be balanced by removing metal from the back wall of the turbine wheel. A fullback turbine wheel is a wheel having a back-wall having a hubline that extends all the way to an inlet tip of the turbine blade, thereby defining an outer diameter. In a fullback turbine wheel design, there is a great deal of material which can be removed from the back in order to balance the turbine wheel. The mixed flow turbine wheel design leaves little metal which can be removed from the back wall of the turbine wheel. Removing material farther from the axis of rotation has greater impact on the inertia of a turbine wheel than removing material closer to the axis. Accordingly, scallop cuts provide good reduction of inertia in fullback turbine wheels suitable for use as radial turbine wheels. Stock removal from the smaller back of mixed flow wheels has less effect on the moment of inertia.

Scallop cuts in the back wall of the turbine wheel, between the turbine wheel blades have been used to reduce the inertia of the turbine wheel. Examples of such wheels are disclosed in U.S. Pat. No. 7,771,170.

U.S. Pat. No. 6,471,474 relates to a rotor assembly for a gas turbine engine operating with reduced circumferential rim stress. The rotor assembly includes a rotor including a plurality of rotor blades extending radially outward from an annular rim. A root fillet extends circumferentially around each blade between the blades and rim. The rim includes an outer surface including a plurality of concave indentations extending between adjacent rotor blades and forming a compound radius. Each indentation extends from a leading edge of the rotor blades towards a trailing edge of the rotor blades.

U.S. Pat. No. 6,511,294 relates to a gas turbine engine rotor assembly including a rotor having a radially outer rim with an outer surface shaped to reduce circumferential rim stress concentration between each blade and the rim. Additionally, the shape of the outer surface directs air flow away from an interface between a blade and the rim to reduce aerodynamic performance losses between the rim and blades. In an exemplary embodiment, the outer surface of the rim has a concave shape between adjacent blades with apexes located at interfaces between the blades and the rim.

U.S. Pat. No. 6,524,070 relates to a rotor assembly for a gas turbine engine operating with reduced circumferential rim stress. The rotor assembly includes a rotor including a plurality of rotor blades and a radially outer platform. The rotor blades extend radially outward from the platform. A root fillet extends circumferentially around each blade between the blades and platforms. The platforms include an outer surface including a plurality of indentations extending between adjacent rotor blades. Each indentation extends from a leading edge of the platform to a trailing edge of the platform with a depth that tapers to an approximate zero depth at the trailing edge.

U.S. Pat. No. 6,942,460 relates to a radial turbine impeller, comprising a circular main disk provided with a plurality of blades, each having a negative pressure surface and a positive pressure surface; scallops being formed by cutting off the main disk between the negative pressure surface of the one blade and the positive pressure surface of the other blade adjacent to the one blade, respectively; wherein a minimum radius portion of the scallop having a minimum distance between a center of the circular main disk and the edge of the scallop is positioned closer to the positive pressure surface so that the scallop is asymmetric between the negative pressure surface of the one blade and the positive pressure surface of the other blade adjacent thereto.

U.S. Pat. No. 7,465,155 relates to a turbomachine blade row having a hub that includes a non-axisymmetric end wall modified by a transformation function. The blade row further includes a circumferential row of a plurality of airfoil members radially extending from the non-axisymmetric end wall of the hub and forming a plurality of sectoral passages therebetween. A radius of the non-axisymmetric end wall is determined by a transformation function including a plurality of geometric parameters defined by a user based on flow conditions. The plurality of geometric parameters provide for modification of the end wall in both an axial and a tangential direction to include a plurality of concave profiled regions and convex profiled regions.

U.S. Pat. No. 7,771,170 relates to a turbine wheel in which the hub/blade junction of each rotor blade is placed with respect to the scalloping surface ($F_1$+$F_2$) such that this surface is supported as symmetrically as possible by the rotor blade. The turbine wheel with three-dimensionally curved rotor blades has scalloping in the area of the hub rear wall, and in consequence is subject to reduced stresses caused by scalloping deformation.

SUMMARY OF THE INVENTION

A mixed flow turbine wheel for a turbocharger is provided comprising a hub extending in an axial direction between a nose and a partial back wall. The back wall includes a peripheral edge and the hub defines an axis rotation extending in the axial direction. A plurality of turbine blades, which extend beyond the peripheral edge of the partial back wall, are coupled to the hub and disposed in a circumferential direction generally at equal intervals around the axis of rotation. At least one scallop cut is formed in the peripheral edge of the partial back wall for balancing the turbine wheel. The scallop cut is positioned along the peripheral edge such that the peripheral edge is not symmetrical in the circumferential direction about the axis of rotation.

Mixed flow turbine wheels do not have full backs because such backs would block the axial flow which is necessary in a mixed flow turbine wheel. Generally, the back wall of a mixed flow turbine wheel is large enough to provide some support to the blades, but not large enough to block the gas flow through the turbine. It has been discovered that asymmetrically placed scallop cuts in the small back wall of a mixed flow turbine wheel can serve to balance the wheel. There may be one or more scallop cuts in the back wall. The scallop cut may be an arc of a circle or may have a more complex shape. The scallop cut may be exactly centered between the blades, or closer to one blade than the other. The scallop cuts are not balanced by matching cuts on the opposite side of the blade. Accordingly, the scallop cuts remove material from the heavier side of the wheel and thus balance the wheel.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EMBODIMENTS

Figure 1:
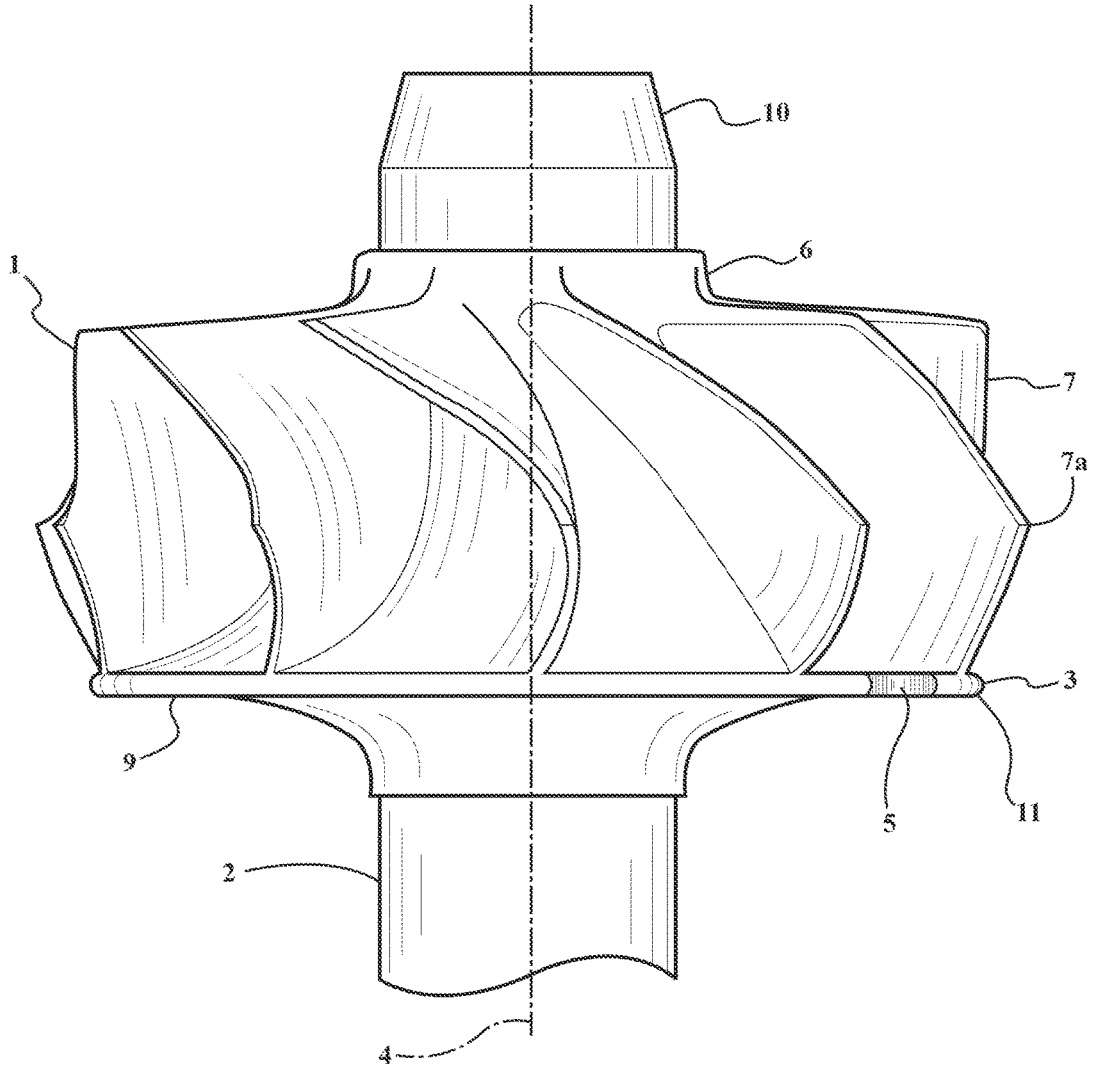
FIG. 1 illustrates a mixed flow turbine wheel mounted on a shaft.

FIG. 1 illustrates a mixed flow turbine wheel (1) mounted on a shaft (2). The turbine wheel (1) includes a scallop cut (5) in the outer peripheral edge (11) of the partial back wall (9), a hub (6), a plurality of turbine blades (7), and a nose (10).

Figure 2:
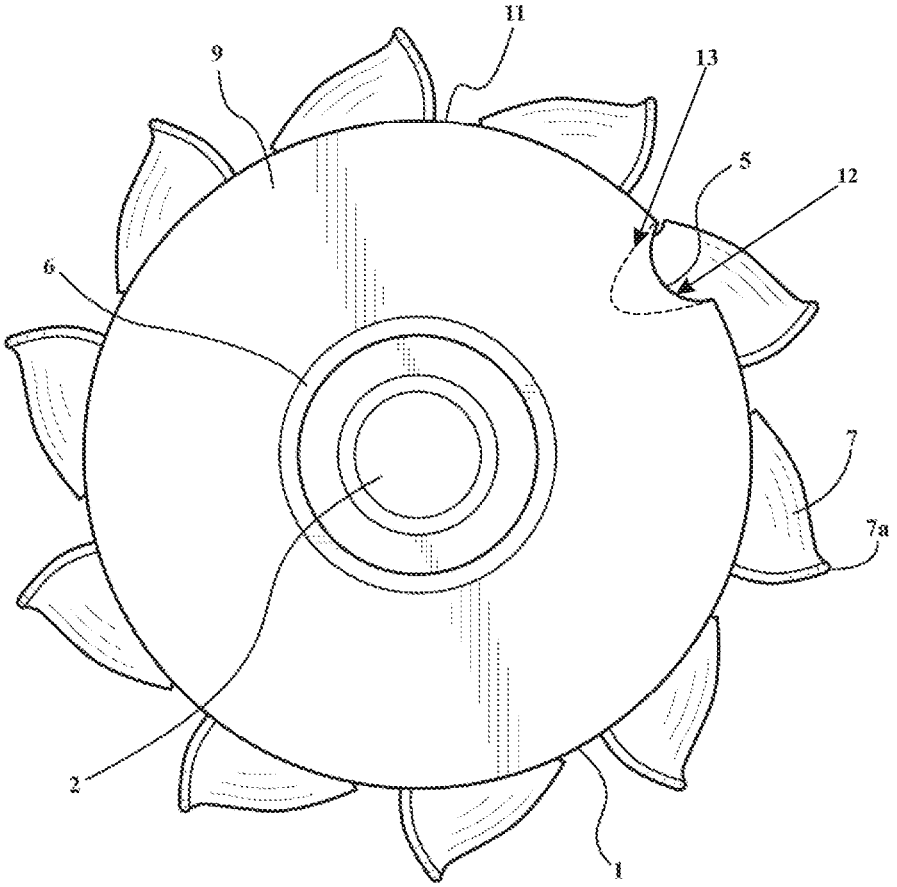
FIG. 2 illustrates the back side of the mixed flow turbine wheel with a scallop cut at the edge of the back.

FIG. 2 illustrates the back side of the mixed flow turbine wheel (1) with a scallop cut (5) in the partial back wall (9), a hub (6), and a plurality of turbine blades (7).

A mixed flow turbine wheel (1) for a turbocharger includes a hub (6) extending in an axial direction between a nose (10) and a partial back wall (9), the back wall (9) including a peripheral edge (11). The hub (6) defines an axis of rotation (4) extending in the axial direction. The turbine wheel (1) includes a plurality of turbine blades (7). The blades (7) are coupled to the hub (6) and are disposed in a circumferential direction generally at equal intervals around the axis of rotation (4). The mixed flow turbine wheel (1) has a partial back wall (9), that is, the tips (7*a*) of the turbine blades (7) extend beyond the outer peripheral edge (11) of the back wall (9). Accordingly, the back wall (9) of a mixed flow turbine wheel (1) is smaller than the back wall of a fullback turbine wheel. It has been discovered that one or more scallop cuts (5) may be made in the back wall (9) of a mixed flow turbine wheel (1). If these cuts (5) are not balanced by similar cuts on the opposite side of the wheel (1) the cuts will serve to balance the wheel. In other words, the wheel (1) can be balanced if the scallop cuts (5) are not symmetrical in a circumferential direction about the axis of rotation (4) of the turbine wheel (1). Cuts (5) in the back wall (9) go through the back wall (9) in an axial direction leaving no thin metal. Thin metal in the back wall (9) is to be avoided because under the conditions of high temperature and high rotation rates in which the turbine wheel operates, areas of thin metal could lead to early failure of the turbine wheel (1).

The scallop cuts (5) are made along the circumference or outer peripheral edge (11) of the back wall (9) and do not touch the blades (7). If a cut extends into a blade (7), it can weaken the blade and lead to early failure of the turbine wheel (1). The cuts (5) need not be centered between adjacent turbine blades (7). A cut may be closer to one blade (7) than another. If necessary to achieve balance, more than one scallop cut (5) can be made in the circumference of the back wall (9) of the turbine wheel (1).

The shape of the scallop cut (5) is generally made in a manner which limits the depth of the cut toward the shaft (2) of the turbocharger in order to avoid weakening the back unnecessarily. Accordingly, the shape of the scallop cut (5) is broader and shallower than a hemispherical cut which removed the same amount of metal. Many shapes may be used in making a scallop cut (5) as long as it is broader and shallower than a hemisphere which removes the same amount of metal. For example, an arc (12) of a larger circle having a central angle of less than 180°, or an ellipse (13) could provide a suitable scallop cut (5).

It is important that weight is not removed from the turbine wheel (1) by grinding or otherwise removing metal from the back of the turbine wheel (1). Although metal removal by grinding the back wall (9) of the turbine wheel (1) can balance the turbine wheel (1), grinding is difficult to control and can lead to unsatisfactory results. In addition such removal can weaken the back of the wheel and lead to failure of the turbine wheel (1).

A method of balancing a turbine wheel (1) includes the steps of: determining which side of the turbine wheel (1) is heavier; and making one or more scallop cuts (5) in a back wall (9) of the turbine wheel (1) between adjacent turbine blades (7) on the heavy side of the turbine wheel (1). In this method, the scallop cuts (5) are made in the shape of an arc (12) of a circle or in the shape of an ellipse (13). In addition, the scallop cuts (5) made in the back wall (9) are placed so as to be asymmetric in a circumferential direction about the axis of rotation (4) of the turbine wheel (1).

While the invention has been shown and described with respect to the particular embodiments, it will be understood by those skilled in the art that various changes and modifications may be made without departing from the scope of the present invention as defined in the following claims.

What is claimed:

1. A mixed flow turbine wheel for a turbocharger comprising:

a hub extending in an axial direction between a nose and a partial back wall, said partial back wall including a peripheral edge at its circumference, wherein said hub defines an axis of rotation extending in said axial direction;

a plurality of turbine blades, which extend beyond said peripheral edge of said partial back wall are coupled to said hub and disposed in a circumferential direction generally at equal intervals around said axis of rotation, wherein the mixed flow turbine wheel is constructed and arranged to allow for a fluid flow in an axial and a radial direction through the mixed flow turbine wheel; wherein each turbine blade of the plurality of turbine blade includes a tip that extends beyond the peripheral edge of the partial back wall, and at least one scallop cut formed in said peripheral edge of said partial back wall for balancing said turbine wheel, wherein said at least one scallop cut is asymmetrically positioned along said peripheral edge and wherein at least a portion of the scallop cut extends all the way through the partial back wall, and wherein the at least one scallop cut is not balanced by a similar at least one scallop cut on the opposite side of the wheel.

2. The turbine wheel as set forth in claim 1 wherein said at least one scallop cut is positioned in said circumferential direction and is centered between two of said plurality of turbine blades.

3. The turbine wheel as set forth in claim 1 wherein said at least one scallop cut is positioned in said circumferential direction and is not centered between two of said plurality of turbine blades.

4. A turbine wheel according to claim 3 wherein the shape of the scallop cut is an arc of a circle.

5. A turbine wheel according to claim 3 wherein the shape of the scallop cut is an ellipse.

6. A method of balancing a turbine wheel comprising:

providing a turbine wheel comprising a plurality of turbine blades and a back wall with a peripheral edge at its circumference;

making one or more scallop cuts in the peripheral edge of the back wall of the turbine wheel between adjacent turbine blades on a peripheral side of a hub of the turbine wheel, wherein at least a portion of the scallop cut extends all the way through the back wall, wherein each turbine blade of the plurality of turbine blade includes a tip that extends beyond the peripheral edge of the back wall, and wherein the at least one scallop cut is not balanced by a similar at least one scallop cut on the opposite side of the wheel.

7. A method of balancing a turbine wheel according to claim 6 wherein the scallop cuts are made in the shape of an arc of a circle.

8. A method of balancing a turbine wheel according to claim 6 wherein the scallop cuts are made in the shape of an ellipse.

9. A method of balancing a turbine wheel according to claim 6 wherein the scallop cuts are asymmetrically positioned on said periphery of said back wall.

* * * * *